US007248826B2

(12) United States Patent
Jones et al.

(10) Patent No.: US 7,248,826 B2
(45) Date of Patent: Jul. 24, 2007

(54) HEATER ROLLER CLEANER, METHOD AND APPARATUS FOR A FUSER ASSEMBLY

(75) Inventors: Kurt E. Jones, Webster, NY (US); Douglas D. Fisher, Marion, NY (US); Paul E. Thompson, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 257 days.

(21) Appl. No.: 11/034,330

(22) Filed: Jan. 12, 2005

(65) Prior Publication Data

US 2005/0158087 A1 Jul. 21, 2005

Related U.S. Application Data

(60) Provisional application No. 60/537,271, filed on Jan. 16, 2004.

(51) Int. Cl.
*G03G 15/20* (2006.01)

(52) U.S. Cl. ..... 399/327; 399/330

(58) Field of Classification Search ..... 399/327, 399/330, 279, 345, 287
See application file for complete search history.

(56) References Cited

U.S. PATENT DOCUMENTS 3,883,292 A * 5/1975 Hamaker ..... 432/60
4,579,802 A * 4/1986 Kishi et al. ..... 430/99
4,634,262 A 1/1987 Imaizumi et al.
4,873,553 A 10/1989 Inaba
5,053,814 A 10/1991 Takano et al.
5,194,890 A 3/1993 Haruna et al.
5,282,001 A 1/1994 Watson
5,339,146 A 8/1994 Aslam et al.
5,434,658 A * 7/1995 Kwon ..... 399/328
5,450,183 A 9/1995 O'Leary
5,493,378 A 2/1996 Jamzadeh et al.
5,521,688 A 5/1996 Moser
5,581,339 A 12/1996 Jamzadeh et al.
5,678,133 A 10/1997 Siegel
5,831,744 A 11/1998 Kataoka
5,852,462 A 12/1998 Lloyd et al.
5,871,878 A * 2/1999 Chatterjee et al. ..... 430/105
6,370,353 B1 * 4/2002 Baughman et al. ..... 399/331
2003/0016972 A1 * 1/2003 Morganti et al. ..... 399/327
2003/0140942 A1 * 7/2003 Rajala et al. ..... 134/6
2003/0210936 A1 * 11/2003 Matsumoto ..... 399/327
2005/0214014 A1 * 9/2005 Baruch et al. ..... 399/69

* cited by examiner

*Primary Examiner*—Anjan Deb
(74) *Attorney, Agent, or Firm*—Donna P. Suchy

(57) ABSTRACT

The fuser roller and heater rollers of the fusing system can become contaminated with ink and other foreign material when pre-printed materials are run through them. The contamination can create regions of cold spots, which in turn results in poor fusing. Other image defects may result. According the various aspects of the invention, a heater roller cleaner, method and apparatus are provided for applying an array of differential pressure generating areas to a heater roller surface in a fuser assembly while rotating the heater roller surface.

22 Claims, 5 Drawing Sheets

HEATER ROLLER CLEANER, METHOD AND APPARATUS FOR A FUSER ASSEMBLY

CROSS REFERENCE TO RELATED APPLICATIONS

This is a 111A application of U.S. Provisional Application Ser. No. 60/537,271, filed Jan. 16, 2004, entitled "HEATER ROLLER CLEANER, METHOD, AND APPARATUS FOR A FUSER ASSEMBLY" by Kurt E. Jones, et al.

BACKGROUND OF THE INVENTION

The fuser roller and heater rollers of the fusing system can become contaminated with ink and other foreign material when pre-printed materials are run through them. The contamination can create regions of cold spots, which in turn results in poor fusing. Other image defects may result.

SUMMARY OF THE INVENTION

According the various aspects of the invention, a heater roller cleaner, method and apparatus are provided for applying an array of differential pressure generating areas to a heater roller surface in a fuser assembly while rotating the heater roller surface.

DETAILED DESCRIPTION OF THE INVENTION

Figure 1:
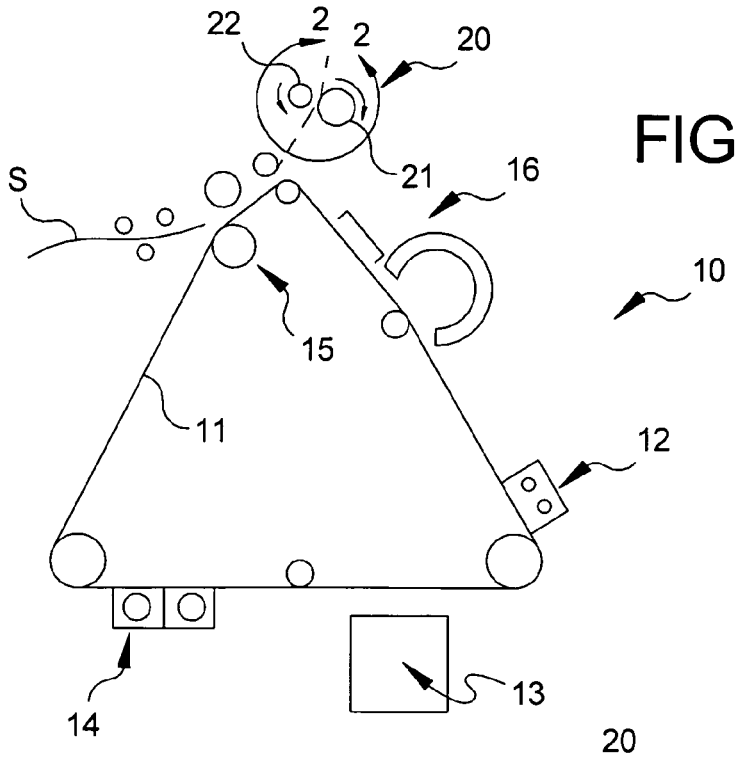
FIG. 1 presents a schematic view of an electrographic apparatus according to an aspect of the invention.

Various aspects of the invention are presented in FIGS. 1-13, which are not drawn to any particular scale, and wherein like components in the numerous views are numbered alike. Referring now to FIG. 1, a typical electrographic apparatus or machine 10 (e.g. copier, duplicator, printer) of the kind that has an endless photoconductor member 11 which moves through a closed loop past a charging station 12, an exposure or input station 13, a developing station 14, a transfer station 15, and an erase section 16. A copy medium (e.g. a sheet S of paper) is fed from a supply (not shown) through transfer station 15 where a toner image on the film 11 is transferred onto the paper S. The paper S is then fed between a fuser roller 21 and a pressure roller 22 in a fuser assembly 20 according to the invention in order to fix the toner image on the paper S before the paper exits the machine. Although described in relation to an electrophotographic embodiment, the invention is equally applicable to other electrographic apparatus and processes, for example ionography, without limitation.

Figure 2:
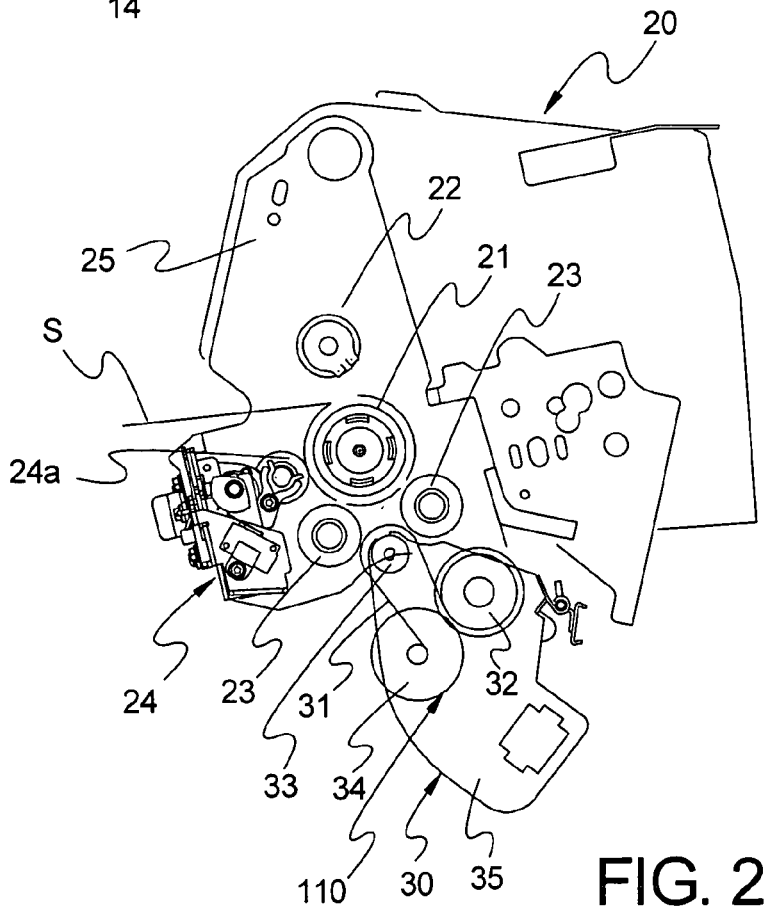
FIG. 2 presents a schematic detailed view of a fuser assembly according to an aspect of the invention.

Referring now to FIG. 2, an end view is presented of a typical fuser assembly 20 which might be found in the electrophotographic machine 10 of FIG. 1. As illustrated, the fuser assembly 20 comprises a frame or housing 25 in which pressure roller 22, fuser roller 21, and one or more heating rollers 23 are rotatably mounted. As will be understood in the art, a motor (not shown) mounted on the housing 25 rotates pressure roller 22 which, in turn, rotates fuser roller 21 and the heater rollers 23 through the frictional contact therebetween. Fuser roller 21 is heated by heating rollers 23 so that when the sheet of paper S or the like passes through the nip between rollers 21, 22, the heat and pressure exerted thereby will cause the toner carried on S to become fused on the paper. The heating rollers 23 may be heated in various ways, for example by a heat lamp disposed inside each roller 23.

A wick roller assembly 24 may be positioned within the housing 25 and includes a wick roller 24*a* for applying a "release" oil directly onto fuser roller 21. This oil helps to prevent "offset", i.e. prevents toner from sticking to the fuser roller 21. Excess oil along with residual toner, paper dust, etc., may build-up on the fuser roller and be transferred to and contaminate heater rollers 23.

To remove these contaminants, a fuser cleaning assembly 30 is provided within fuser housing 25 which includes a web 31 of material which contacts the heater rollers 23 to "wipe" and remove the contaminants therefrom as the copying operation is being carried out. As is known in the art, web 31 may be comprised of any flexible, cleaning material which is capable of removing the contaminants from the heater rollers upon contact (e.g. cloth-like material composed of Nomexg® polyarimide fiber available from E. I. Dupont and de Nemours, & Co.) without damaging the heater rollers 23. The cleaning material 31 is wound onto a supply roller 32 and passes over a roller 33 and onto take-up roller 34. The roller 33 holds material in contact with both of heater rollers 23 when assembly 30 is in its operable position within fuser housing 25. The supply roller 32, heater roller cleaner 110, and take-up roller 34 are mounted on a frame 35 using suitable bearings. The fuser cleaning assembly may be removable from the machine on a slide, as described in U.S. Pat. No. 6,631,251.

Figure 3:
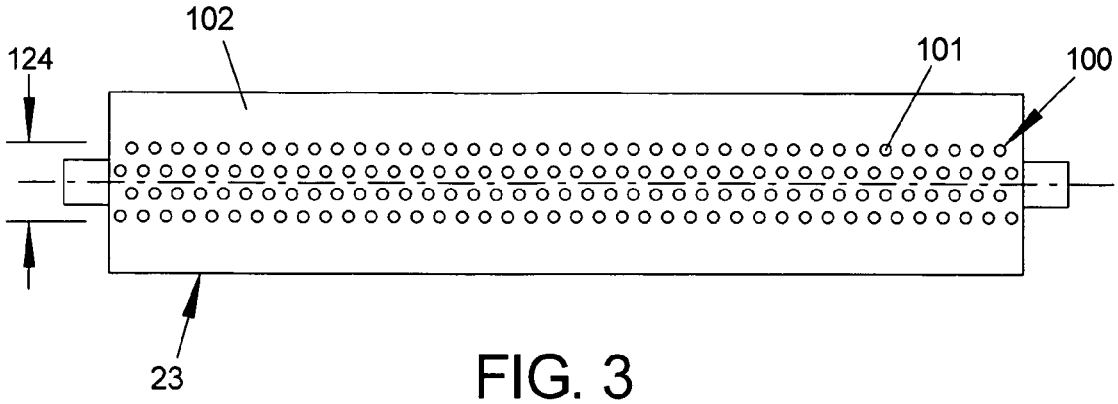
FIG. 3 presents a heater roller and array of differential pressure generating areas according to an aspect of the invention.
Figure 4:
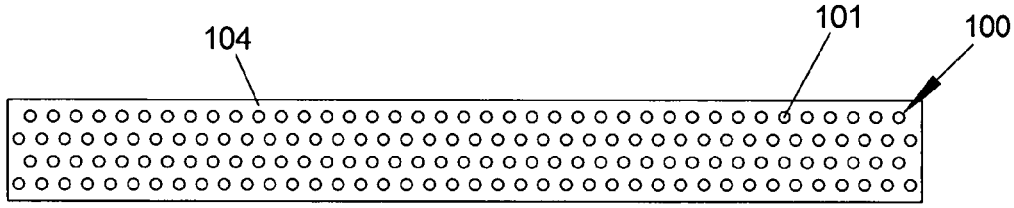
FIG. 4 presents a cleaning surface according to an aspect of the invention.
Figure 5:
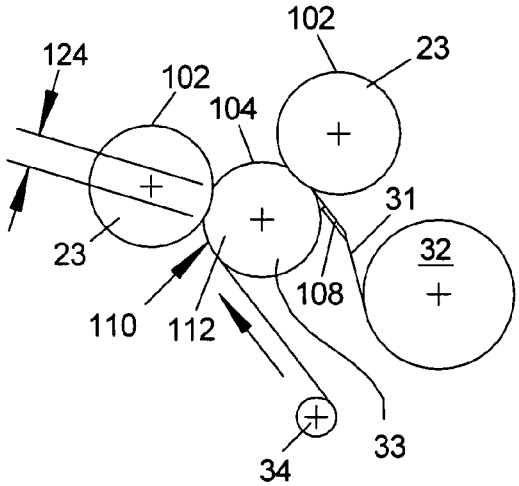
FIG. 5 presents a schematic view of a fuser cleaning assembly according to an aspect of the invention.

Referring now to FIG. 3, a method of cleaning the heater roller 23 in the fuser assembly 20, comprising applying an array 100 of differential pressure generating areas 101 to a heater roller surface 102 in the fuser assembly 20 while rotating the heater roller surface 102. The differential pressure generating areas 101 preferably generate a greater pressure in corresponding areas of the heater roller surface 102 than in adjacent areas. Referring now to FIG. 4, the method may comprise contacting the heater roller surface 102 with a cleaning surface 104 comprising the array 100 of the differential pressure generating areas 101. The array 100 of differential pressure generating areas 101 may be pressed against the heater roller surface 102. Referring now to FIG. 5, the cleaning surface 104 may comprise the web 31 and the web 31 contacts and may be pressed against the heater roller surface 102. The web 31 may be passed along the heater roller surface 102 over the array 100 of differential pressure generating areas 101. The method may also comprise separating the web from the array 100 of differential pressure generating areas 101 with a separator 108 that may be disposed on the downstream side.

The array 100 of differential pressure generating areas 101 may comprise 5 to 200 points of contact per square inch. Other ranges are contemplated in the practice of the invention, such as 10 to 100 points of contact per square inch and 40 to 100 points of contact per square inch. The differential pressure generating areas 101 are preferably discontinuous and discrete.

The cleaning surface 104 may be the web 31 having an appropriately textured surface. The web 31 may have an abrasive surface.

Preferably, a textured surface is placed beneath the web 31 and presses the web 31 against the heater roller surface 102. Molded and tooled surfaces are suitable in the practice of the invention. Elastomers, plastics and metals are all suitable materials. A knurled surface or woven screen surface may be implemented. A 60-150 grit surface may be implemented with grit particles bonded to a backing material with an adhesive having suitable heat resistance. A resilient surface, as provided by an elastomer or brush bristle for example, may be advantageous. A width 124 of contact between the cleaning surface and the heater roller surface 102 may be on the order of 0.12 inch to 0.30 inch, although the invention is not so limited. Variations evident in light of the description provided herein are innumerable.

The array 100 of differential pressure generating areas 101 may be ordered or random. Consideration may be given for moving the array 100, for example parallel to the heater roller surface 102 axis of rotation in order to ensure that cleaning is applied to the entire heater roller surface 102. This may be particularly desired if the array 100 is ordered since a patterned removal of contamination may result.

The web 31 serves a cleaning function in addition to cleaning the heater roller surface 102 by preventing build-up of contaminates in the array 100 of pressure generating areas 101. However, the web 31 need not be implemented in the practice of the invention. An alternate cleaning mechanism for cleaning the array 100 of pressure generating areas 101 such as a beater bar and/or vacuum cleaner may serve the same purpose. For example, the array 100 of pressure generating areas 101 may be a rotating brush and may be cleaned by a beater bar and/or vacuum cleaner.

Figure 6:
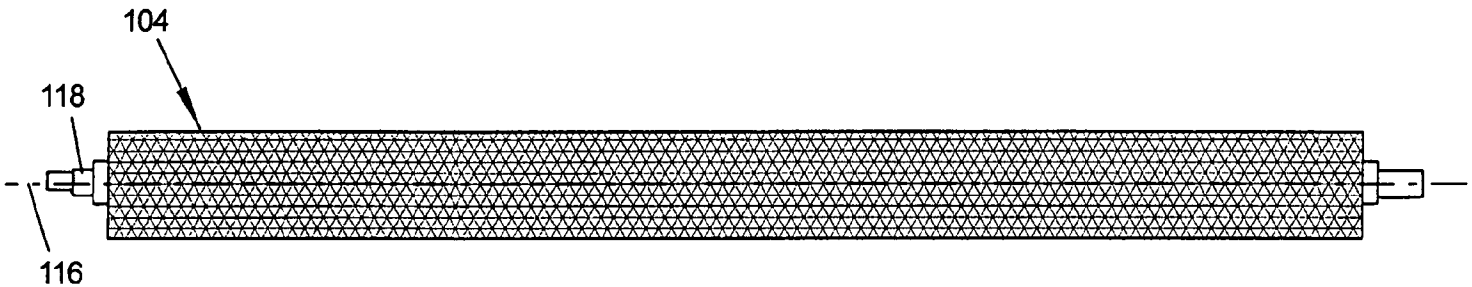
FIG. 6 presents a cleaning surface according to a further aspect of the invention.
Figure 7:
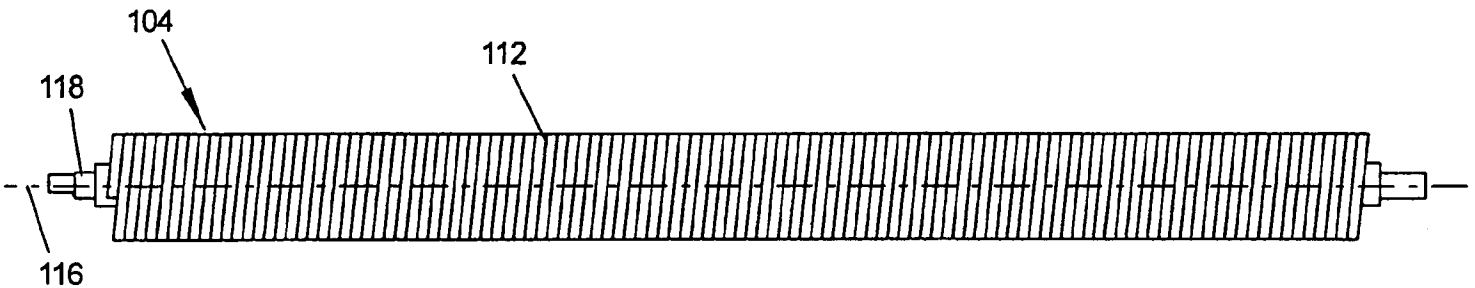
FIG. 7 presents a cylindrical brush according to an aspect of the invention.
Figure 8:
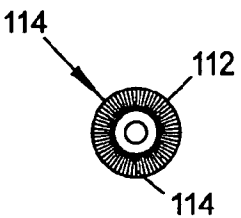
FIG. 8 presents an end view of the FIG. 7 cylindrical brush.

With reference to FIGS. 5 and 6, and according to a further aspect of the invention, a heater roller cleaner 110 is provided with the array 100 of differential pressure generating areas 101 applicable to the heater roller surface 102. The heater roller cleaner 104 may be a cylindrical brush comprising metal and/or plastic bristles. Brush bristles provide resilience that is advantageous particularly when the brush is pressed against the heater roller surface 102. The interference between the brush and the heater roller 23 may be on the order of 0.003 inch to 0.02 inch, inclusive. According to a preferred embodiment, a brush 112 is fully composed of metal bristles 114 only, such as brass, arranged in a helix along a longitudinal axis 116 of the brush 112 and attached to a shaft 118, as shown in FIGS. 7 and 8. Shaft 118 may be steel or other material suitable in the practice of the invention. The brush is believed to develop a scrubbing action on the heater roller surface 102.

Figure 13:
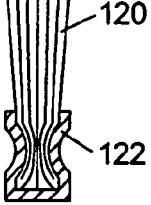
FIG. 13 presents a cross-sectional view of a brush bristle/channel according to an aspect of the invention.

In a certain embodiment, the shaft 118 is stainless steel with a ⅜" outside diameter and is about 15 inches long. The brush has a 1¼ inch outside diameter brush face. The bristles are composed of 0.003 inch diameter brass wire. Bristles 120 of this brush are crimped in a galvanized channel 122, as shown in FIG. 13, and the channel 122 (with the bristles 120 crimped to it) is wound in a helix along the shaft 118, and tack welded to the shaft 118 at both ends. A suitable brush is available from The Industrial Brush Company Inc., of Fairfield, N.J., U.S.A. ("#2 galvanized close wound 0.003 level brass"). In this embodiment, the heater roller 23 is 5052 aluminum having a 1.5 inch outside diameter and a hard anodized outer coating. The width 124 of contact between the brush/web and heater roller surface 102 is on the order of 0.22 inches.

Figure 9:
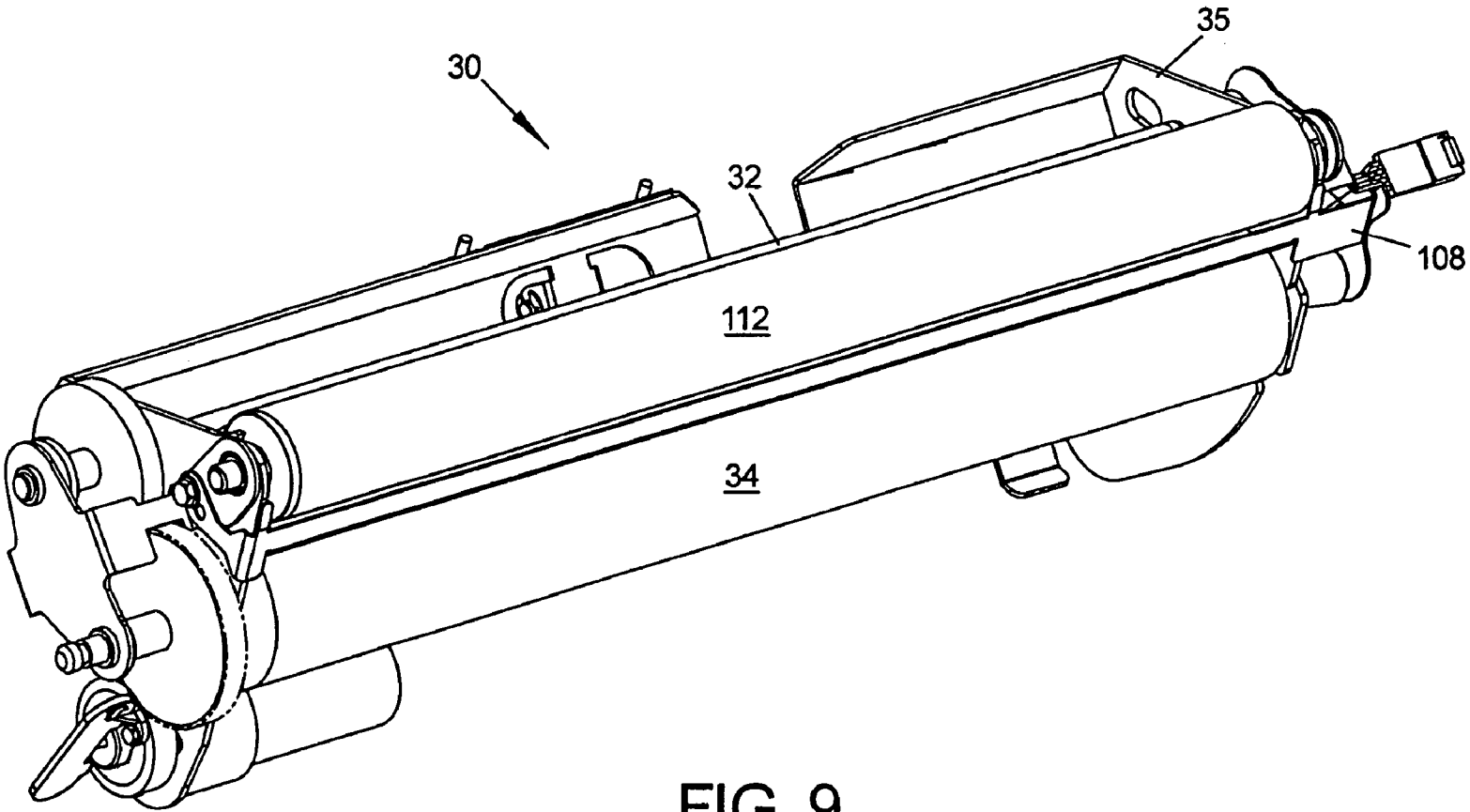
FIG. 9 presents a perspective view of a fuser cleaning assembly according to an aspect of the invention.

Referring to FIG. 9, a perspective view of a fuser cleaning assembly 30 adapted for use with the fuser assembly 20 of FIG. 2 and the brush 112 of FIGS. 7 and 8 is presented (the brush 112 replaces the roller 33). The separator 108 is implemented. The web 31 is not shown for the sake of clarity, and the web take-up roller 34 is in a full condition, and the web-supply roller 32 is in an empty condition (just prior to replacement, for example). In the FIG. 9 embodiment, the brush 112 comprises brass bristles, and is incremented with the web 31 every 275 prints. Experiments have demonstrated that the heater roller surfaces 102 are maintained in a suitably clean state for 750,000 prints as compared to 100,000 prints for the prior art system, which implemented a cylindrical elastomeric tensioner roller with a smooth surface in place of the brush 112.

The dimensions of the brush 112 determine, in part, the rate at which it and the web 31 are incremented. As the brush 112 is rotated, the rows of bristles 114 in contact with the heater roller surface 102 advance parallel to the longitudinal axis 116 due to their helical arrangement around the shaft 118. Selection of an appropriate rate at which the brush 112 and web 31 are incremented, and thus the rotation rate, ensures that the entire heater roller surface 102 is sufficiently cleaned, and prevents an unacceptable patterned removal of contamination. The rate at which the brush 112 and web 31 are incremented is best determined by experimentation.

Figure 10:
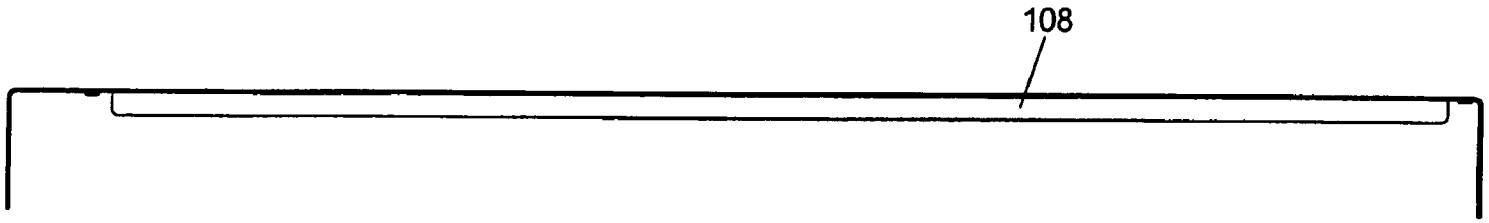
FIG. 10 presents a top view of a separator according to an aspect of the invention.
Figure 11:
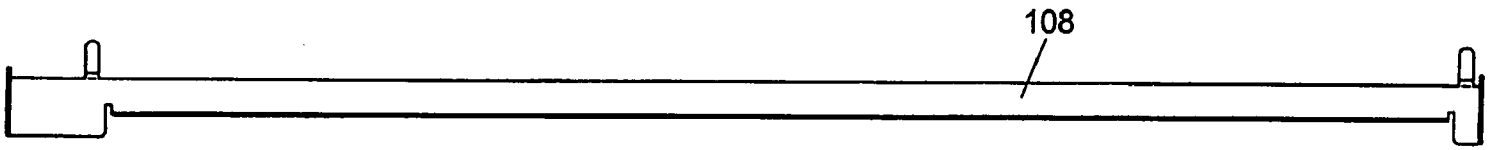
FIG. 11 presents a side view of the FIG. 10 separator.
Figure 12:
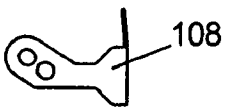
FIG. 12 presents an end view of FIG. 11.

Top, side, and end views of the separator 108 of FIG. 9 are presented in FIGS. 10, 11, and 12, respectively. The separator 108 of FIGS. 9-12 is formed from a suitably stiff material such as stainless steel 0.03 inch thick so as to resist a pulling force in the direction of web travel.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

PARTS LIST

S sheet
10 electrographic apparatus or machine
11 photoconductor member
12 charging station
13 exposure or input station
14 developing station
15 transfer station
16 erase section
20 fuser assembly
21 a fuser roller
22 pressure roller

23 heater rollers
24 wick roller assembly
24*a* wick roller
25 frame or housing
30 fuser cleaning assembly
31 web
32 supply roller
33 roller
34 take-up roller
35 frame
100 array
101 differential pressure generating areas
102 heater roller surface
104 cleaning surface
108 separator
110 heater roller cleaner
112 brush
114 metal bristles
116 longitudinal axis
118 shaft
120 bristles
122 channel
124 width

The invention claimed is:

1. A method of cleaning a heater roller located proximate a fuser roller that is heated by the heater roller in a fuser assembly, comprising:

contacting a heater roller with a web of material which to remove contaminants; and applying an array of differential pressure generating areas to a heater roller surface in said fuser assembly while rotating said heater roller surface.

2. The method of claim 1, comprising:

contacting said heater roller surface with a cleaning surface comprising said array of said differential pressure generating areas.

3. The method of claim 1, said cleaning surface comprising a web.

4. The method of claim 1, comprising:

pressing a cleaning surface comprising said array of said differential pressure generating areas against said heater roller surface.

5. The method of claim 1, said cleaning surface comprising a web.

6. The method of claim 1, comprising:

pressing a web against said heater roller surface.

7. The method of claim 1, comprising:

passing a web along said heater roller surface over said array of differential pressure generating areas.

8. The method of claim 1, comprising:

contacting said heater roller surface with a heater roller cleaner comprising said array of differential pressure generating areas and a web; and, separating said web from said array of differential pressure generating areas with a separator.

9. A heater roller cleaner located proximate a heater roller and a fuser roller in a fuser assembly such that the heater roller cleaner cleans the heater roller that heats the fuser roller, the heater roller cleaner comprising:

a web of material which to remove contaminants from the heater and an array of differential pressure generating areas applicable to a heater roller surface in fuser assembly.

10. The heater roller cleaner of claim 9, comprising:

a cylindrical brush.

11. The heater roller cleaner of claim 9, said cylindrical brush comprising metal bristles.

12. The heater roller cleaner of claim 9, said cylindrical brush comprising metal bristles arranged in a helix along a longitudinal axis of said cylindrical brush.

13. The heater roller cleaner of claim 9, said cylindrical brush comprising plastic bristles.

14. The heater roller cleaner of claim 9, comprising a textured metal, plastic, or elastomeric surface.

15. The heater roller cleaner of claim 9, comprising a web.

16. A fuser cleaning apparatus including a heater roller located proximate a fuser roller that is heated by the heater roller, the fuser cleaning apparatus comprising:

a heater roller cleaner comprising an array of differential pressure generating areas applicable to a heater roller surface in a fuser assembly.

17. The fuser assembly of claim 16, said heater roller cleaner comprising a cylindrical brush.

18. The fuser assembly of claim 16, said cylindrical brush comprising metal bristles.

19. The fuser assembly of claim 16, said cylindrical brush comprising metal bristles arranged in a helix along a longitudinal axis of said cylindrical brush.

20. The fuser assembly of claim 16, said cylindrical brush comprising plastic bristles.

21. The fuser assembly of claim 16, said heater roller cleaner comprising a textured metal, plastic, or elastomeric surface.

22. The fuser assembly of claim 16, comprising a heater roller cleaner contacting said heater roller surface, said heater roller cleaner comprising said array of differential pressure generating areas and a web; and a separator operative to separate said web from said array of differential pressure generating areas.

* * * * *